US005626486A

United States Patent [19]

Shelly et al.

[11] Patent Number: 5,626,486

[45] Date of Patent: May 6, 1997

[54] HIGH VOLTAGE LOW CURRENT CONNECTOR INTERFACE WITH COMPRESSIBLE TERMINAL SITE SEAL

[75] Inventors: Christopher W. Shelly, Hummelstown, Pa.; James D. Hutchinson, London, England

[73] Assignee: The Whitaker Corporation, Wilmington, Del.

[21] Appl. No.: 402,081

[22] Filed: Mar. 10, 1995

[51] Int. Cl.[6] ..... H01R 15/00

[52] U.S. Cl. ..... 439/281; 439/273

[58] Field of Search ..... 439/281, 282, 439/272–274, 279

[56] References Cited

U.S. PATENT DOCUMENTS

| | | | |
|---|---|---|---|
| 3,328,744 | 6/1967 | Fiske . | |
| 3,402,381 | 9/1968 | Gaw et al. . | |
| 3,522,575 | 8/1970 | Watson et al. . | |
| 3,533,047 | 10/1970 | McFarlane . | |
| 3,609,636 | 9/1971 | Kubin et al. | 439/281 |
| 3,747,048 | 7/1973 | Johnson et al. . | |
| 3,750,084 | 7/1973 | Gardner . | |
| 3,824,526 | 7/1974 | Glover . | |
| 3,842,389 | 10/1974 | Glover et al. . | |
| 3,842,393 | 10/1974 | Glover et al. . | |
| 3,850,495 | 11/1974 | Glover | 439/279 |
| 3,851,296 | 11/1974 | Muchmore et al. | 439/281 |
| 3,852,512 | 12/1974 | Herrmann, Jr. | 174/19 |
| 3,871,735 | 3/1975 | Herrmann, Jr. . | |
| 3,888,559 | 6/1975 | Geib . | |
| 3,945,708 | 3/1976 | Griffin . | |
| 3,963,295 | 6/1976 | Askman et al. . | |
| 3,994,553 | 11/1976 | Kornick . | |
| 4,090,759 | 5/1978 | Herrmann, Jr. . | |
| 4,116,521 | 9/1978 | Herrmann, Jr. . | |
| 4,417,736 | 11/1983 | Herrmann, Jr. | 277/212 R |
| 4,605,272 | 8/1986 | Myers et al. . | |
| 4,684,189 | 8/1987 | Swaffield | 439/587 |
| 4,707,045 | 11/1987 | Ney et al. | 439/588 |
| 4,886,463 | 12/1989 | Scott et al. | 439/272 |
| 4,886,471 | 12/1989 | Fleshman, Jr. | 439/587 |
| 4,904,198 | 2/1990 | Begitschke et al. | 439/281 |
| 4,986,764 | 1/1991 | Eaby et al. | 439/275 |
| 5,080,600 | 1/1992 | Baker et al. | 439/258 |

OTHER PUBLICATIONS

*AMP Catalog 73–218*, "LGH High Voltage Lead Assemblies, Connectors and Receptacles", Revised Feb. 1984; pp. 1–5, 24–29, 55, 56; AMP Incorporated, Harrisburg, PA.

*Reynolds Industries Catalog*, "Subminiature High Voltage Connectors & Cable Assemblies", eleven pages; 1986; Reynolds Industries Inc., Freehold, NJ.

*Primary Examiner*—Gary F. Paumen
*Assistant Examiner*—Jill Demello
*Attorney, Agent, or Firm*—Anton P. Ness

[57] ABSTRACT

A high voltage electrical connector assembly having a first connector (12) with socket terminals (44), matable with a second connector (14) having pin terminals (58). Socket terminals (44) are disposed in respective gradually tapered silos (40) of elastomeric material, and the second connector (14) is formed of rigid dielectric material to include silo-receiving recesses (50) surrounding the pin contact sections (56) of the pin terminals (58). Each silo (40) includes a leading end portion extending a selected distance beyond the socket contact section leading end (72) and abuts the recess bottom (96) prior to full connector mating. Upon completion of connector mating, the silos (40) are longitudinally compressed at their leading end portions (74) and thereby become radially expanded to tightly engage the inner surfaces (128) of the silo-receiving recesses (50) and establish compression seals (130) therewith therealong to define sealing of the mating interface against voltage leakage paths that otherwise would permit generation of corona.

18 Claims, 7 Drawing Sheets

HIGH VOLTAGE LOW CURRENT CONNECTOR INTERFACE WITH COMPRESSIBLE TERMINAL SITE SEAL

FIELD OF THE INVENTION

The present invention relates to the field of electrical connectors and more particularly to matable connectors containing matable electrical contacts for high voltage low current interconnections.

BACKGROUND OF THE INVENTION

Electrical connectors are frequently used to provide electrical connection in high voltage, low current energy systems, e.g., in systems carrying about 1000 volts up to about 50 Kv at one-half ampere or less, and the electrical transmission may be continuous or pulsed. Such connectors must operate with high reliability, often under severe environmental conditions. For example, connectors are frequently incorporated into high-voltage, electronic circuits located in hostile environments and must maintain peak performance within a broad temperature range and under diverse vaporous and gaseous conditions. In aircraft, such systems must have high reliability in a temperature range of from −55° C. to +125° C. and from sea level to 70,000 feet altitude, where ambient pressure is substantially lower than at sea level.

The primary problems with such high voltage applications are the discharge of voltage along a path from the connection to the environment, and the formation of corona (or voltage leakage) around the connection; both problems are aggravated under high altitude, extreme temperature conditions. Voltage discharge is a failure of the connector requiring connector replacement. Corona formation and voltage leakage commonly leads to degradation and possible breakdown of the dielectric insulation around the terminals and the conductors of the conductor wires, which commonly leads eventually to voltage discharge. To minimize corona formation and avoid voltage leakage and accompanying dielectric voltage breakdown, it is necessary that an assured airtight dielectric seal established about the terminals in their mated condition, and at the termination of the terminals with their respective conductors.

In prior art connectors for high voltage, resistance to corona formation and resultant voltage discharge is built into the connector housings by careful selection of dielectric materials, housing structure design and assembly of the terminals into the housings. In one typical high voltage connector arrangement, the pin terminal is molded within a multi-terminal receptacle housing which is adapted to be mounted to a bulkhead, and the socket terminal is disposed within a multi-terminal plug housing. The housings are secured together after mating through a conventional coupling ring rotatably mounted on the plug housing and threadedly engageable with the cylindrical housing flange defining a receptacle wall surrounding a respective pin contact section of each pin terminal in the receptacle housing. Conventionally where the terminals are inserted into passageways of a premolded housing, the conductor wires exit from the rearward housing faces and potting material is used to seal the gap between the wire insulation and the housing; the potting material minimizes the possibility of voltage discharge from the rearward face of the connector.

In U.S. Pat. No. 4,886,471, the socket terminal is terminated to a conductor wire and a respective plug housing is molded therearound of silicone rubber, and has a long axial recess extending axially thereinto from the forward face thereof to receive force-fittably thereinto the receptacle wall of the mating receptacle housing so that the silicone rubber plug wall forces practically all air from the cavity and establishes a tight grip along the inside and outside surfaces of the rigid receptacle wall; the tight air-free grip is sufficient to establish assured sealing around the mated contact interface and also adequate resistance to unintentional decoupling without other fastening means but permit intentional decoupling under sufficient axial force.

In a product of AMP Incorporated known as an LGH High Voltage Lead Assembly, Part No. 1-846290-7, a socket terminal terminated onto an insulated length of conductor undergoes an insert molding process to mold therearound a plug housing of silicone rubber such that the housing material is bonded to outer surfaces of the terminal and to an adjacent portion of the conductor. The plug housing is molded to define a gradual taper to its forward end coincident with the socket terminal's forward end. The mating receptacle housing containing the pin terminal is molded of rigid dielectric material to define a cylindrical cavity into which the plug housing is received during connector mating to form a sealed mating interface surrounding the site of the mated terminals.

It is desired to provide improved high voltage sealing in a matable electrical connector assembly to resist voltage leakage at above 15 kilovolts.

It is desired to provide a sealed mating interface around each mated terminal pair by generating substantial compression between elastomeric material and rigid material at substantially all surface-to-surface interfaces immediately about the terminal site.

SUMMARY OF THE INVENTION

In accordance with the present invention, mating connectors contain at least one mating terminal pair, and one of the connectors contains at least one socket terminal and provides a portion of elastomeric material extending beyond the socket contact leading end. The rigid housing of the mating connector contains at least one pin terminal provides a portion-receiving recess along the pin contact base portion and adapted to receive thereinto the elastomeric portion. Upon connector mating, the elastomeric portion extends along and is only incrementally spaced from the base portion of the pin contact section. The connectors are adapted such that in final stages of connector mating, the recess bottom abuts the leading end of the elastomeric portion and axially compresses the portion such that the portion is deformed outwardly against side walls of the recess to define a discrete terminal site seal adjacent and along at least the pin contact base section of each mated terminal pair. The connectors disclosed herein may take the form of inserts disposed within matable connector assemblies containing pin and socket terminals for conventional low voltage signal transmission and also coaxial terminals.

More specifically, the second connector's housing includes a housing section of rigid dielectric material with apertures therethrough corresponding to the respective high voltage socket terminals. Disposed in each of the apertures is an member of elastomeric material such as silicone rubber containing the respective socket terminal and extending rearwardly through the aperture from the mating face to a wire exit face. Each elastomeric member is preferably not bonded to side walls of the aperture, and not bonded to the surfaces of the socket contact section of the terminal. Each elastomeric member is shaped as a frustoconical elongate silo around the socket contact section of the socket terminal, with the leading end of the socket contact section recessed a selected distance from the silo leading end, and preferably spaced rearwardly from a silo leading end portion having a reduced inner diameter.

The first connector's housing is of substantially rigid dielectric material, with the high voltage pin terminals retained within respective passageways therethrough from a wire exit face to a mating face. The mating face of the of the first connector's housing defines frustoconical silo-receiving recesses within which the pin contact sections are exposed, with the pin contact sections extending a substantial distance forwardly of the recess bottoms to leading ends recessed from the entrances thereto, and with the recesses adapted to receive thereinto the respective slightly frustoconical elongate silos of the elastomeric inserts of the first connector.

In the present invention, the silo of each elastomeric insert protrudes forwardly a limited selected distance beyond the leading end of the socket contact section contained therein. Preferably the silo and the silo-receiving recess are complementarily tapered with smooth facing surfaces adapted to become intimately engaged upon full connector mating, to provide sealing. The length of each silo is slightly longer than the length of the silo-receiving recess, so that the leading end portion of the silo becomes compressed longitudinally upon abutment with the bottom of the silo-receiving recess at the base of the pin contact section. Longitudinal compression of the silo leading end results in the silo becoming radially expanded firmly against the inwardly facing surface of the silo-receiving recess to seal thereagainst, and becoming progressively expanded thereagainst along the length of the silo-receiving recess to the forward end of the first connector and away from the mating terminal pair. The air is thus progressively forced away from the pin and socket contact sections and is expressed essentially completely from the mating interface during final stages of connector mating, to minimize formation of voltage leakage paths and to inhibit corona formation during high voltage low current transmission.

It is an objective of the present invention to provide a matable electrical connector assembly for high voltage electrical transmission, that minimizes the formation of voltage leakage paths and corona.

It is another objective for such connector to provide for expression of air in a path away from the mating electrical terminals just prior to full connector mating, thus eliminating, or minimizing the amount of, trapped air along the mating interface and also locate any remaining incremental pockets of trapped air farther from the mated electrical terminals.

It is yet another objective to provide a discrete terminal site seal, permitting use in a connector having a single terminal site or a plurality thereof, assuring sealing about each terminal upon full connector mating.

It is a further objective to provide effective high voltage sealing between adjacent surfaces of elastomeric and rigid material with minimal friction-resisted movement that otherwise would cause material wear, all thereby providing a more durable elastomeric sealing member.

An embodiment of the present invention will now be described by way of example with reference to the accompanying drawings.

DETAILED DESCRIPTION OF THE PREFERRED EMBODIMENT

Figure 1:
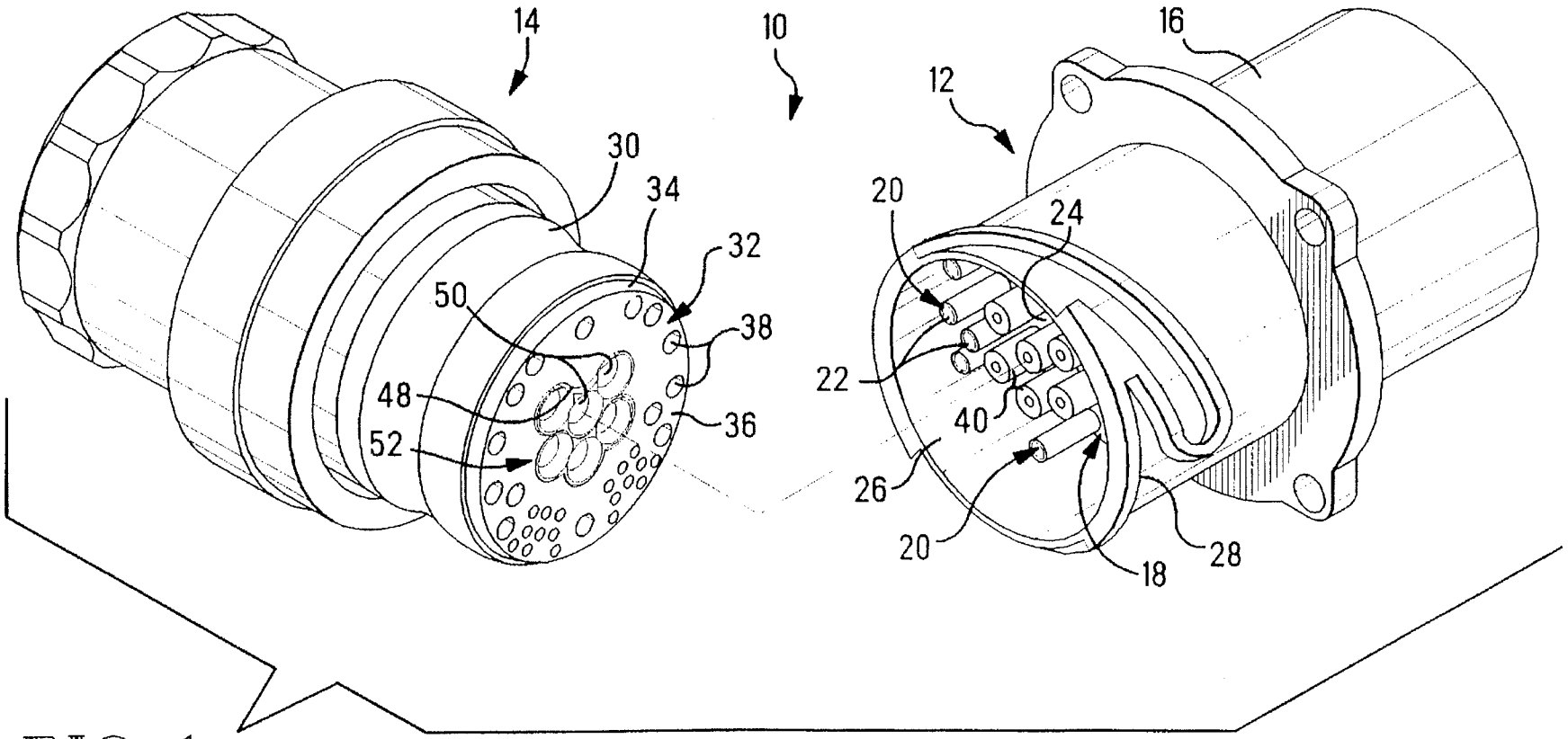
FIG. 1 is an isometric view of the mating faces of matable electrical connectors containing inserts for high voltage low current electrical connections.

A cylindrical connector 10 is shown in FIG. 1 of the type having a receptacle connector 12 and a plug connector 14 matable therewith. Receptacle connector 12 is shown to be an assembly of a protective cylindrical shell 16 of durable material such as metal, a housing assembly 18 of dielectric material mounted within shell 16 and through which extend socket terminals 20 having socket contact sections 22 extending forwardly of mating face 24 into plug-receiving cavity 26 defined by a shroud 28 comprised of a forward portion of shell 16. Plug connector 14 is shown to be an assembly of a protective cylindrical shell 30 of durable material such as metal, a housing assembly 32 of dielectric material mounted within shell 30, and a plurality of pin contacts (not shown). Plug connector 14 includes a plug portion 34 extending forwardly to a mating face 36, and the leading ends of the pin terminals are recessed from mating face 36 in respective passageways 38. During connector mating, socket contact sections 22 will enter passageways 38 and enter into electrical engagement with the pin contact sections of the pin terminals therewithin. Housing assemblies 18 and 32 preferably are comprised of forward and rearward housing sections secured within respective shells 16 and 30 by a pair of screws passing through adjacent transverse flange portions (not shown) thereof, internal to shells 16 and 30.

Figure 6:
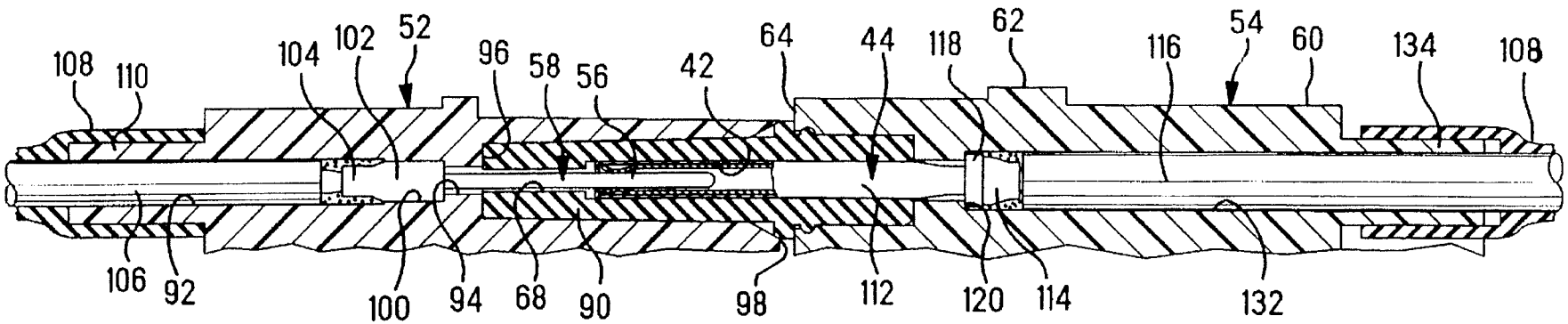
Figure 7:
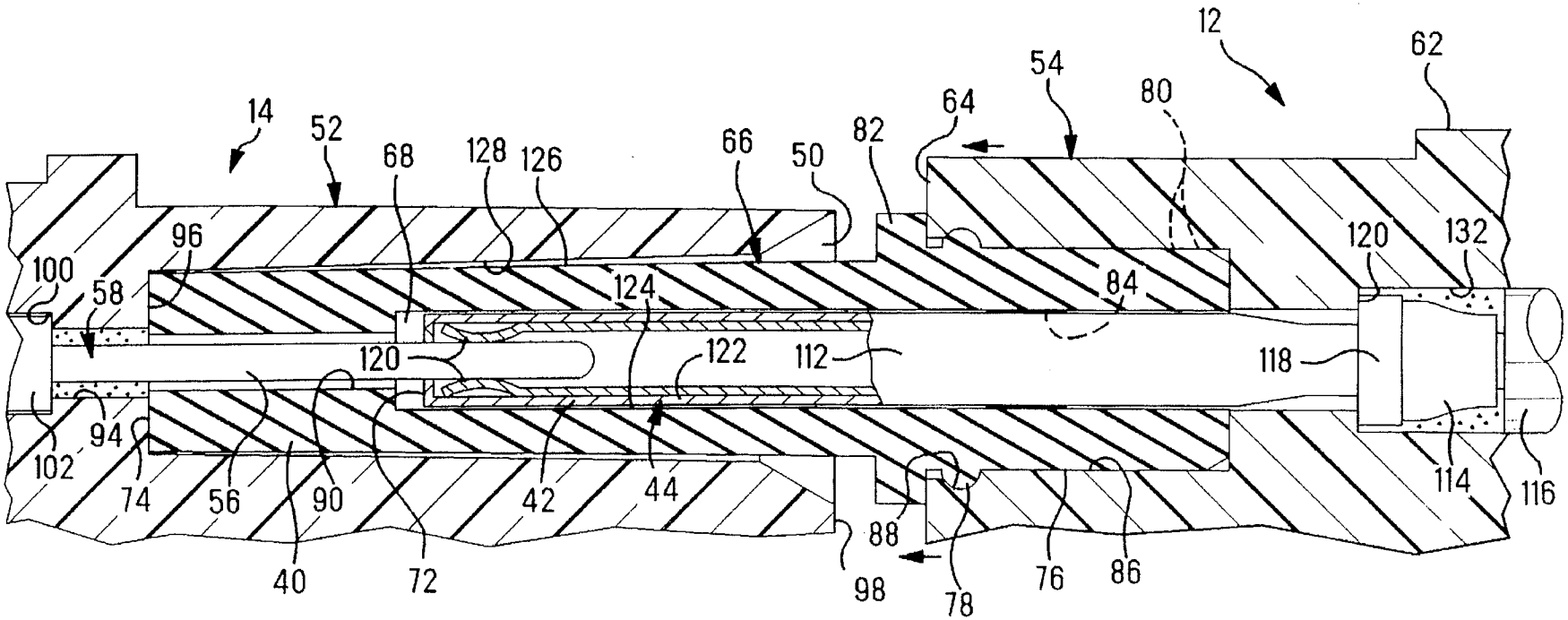
FIGS. 7 to 9 are enlarged section views of the socket and pin terminal sites of FIGS. 5 and 6 during connector mating, with FIG. 7 partially mated, FIG. 8 almost fully mated and FIG. 9 fully mated and the terminal sites sealed.
Figure 8:
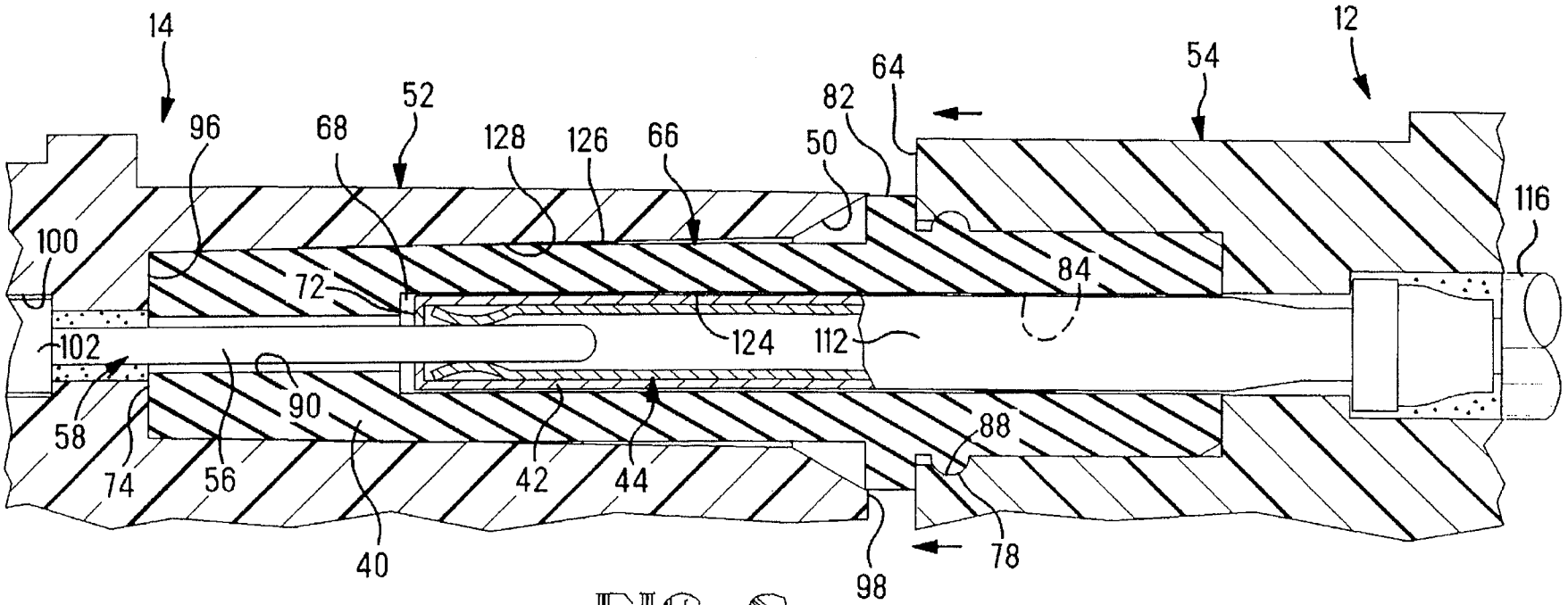

In the central region of mating face 24 of receptacle connector 12 is seen an array of (six) silos 40 extending forwardly therefrom within shroud 28 within each of which is disposed a socket contact section 42 of a socket terminal 44 (seen in FIGS. 6 to 8). Central region 46 is better seen in FIG. 2. Correspondingly, in the central region 48 of mating face 36 of plug connector 14 is an array of (six) silo-receiving recesses 50 adapted to receive thereinto the silos 40 of receptacle connector 12 during connector mating.

Figure 2:
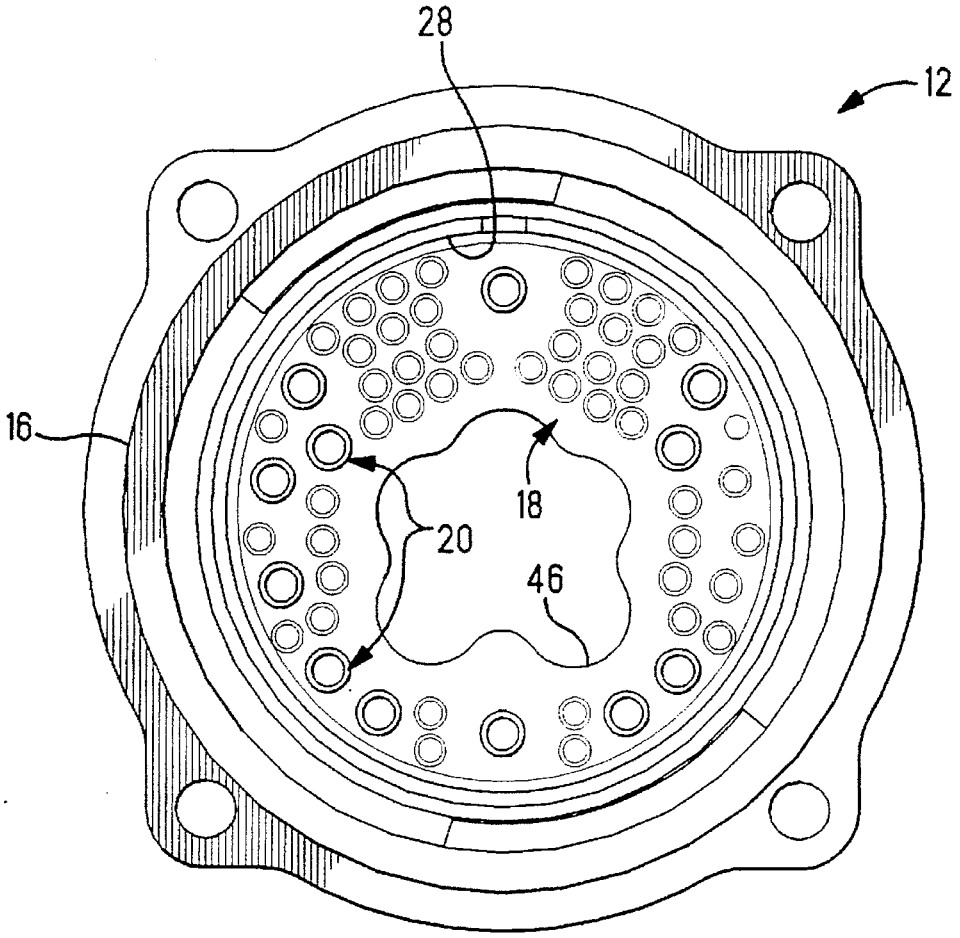
FIG. 2 is a front view of a connector of FIG. 1 illustrating the location for an insert.
Figure 4:
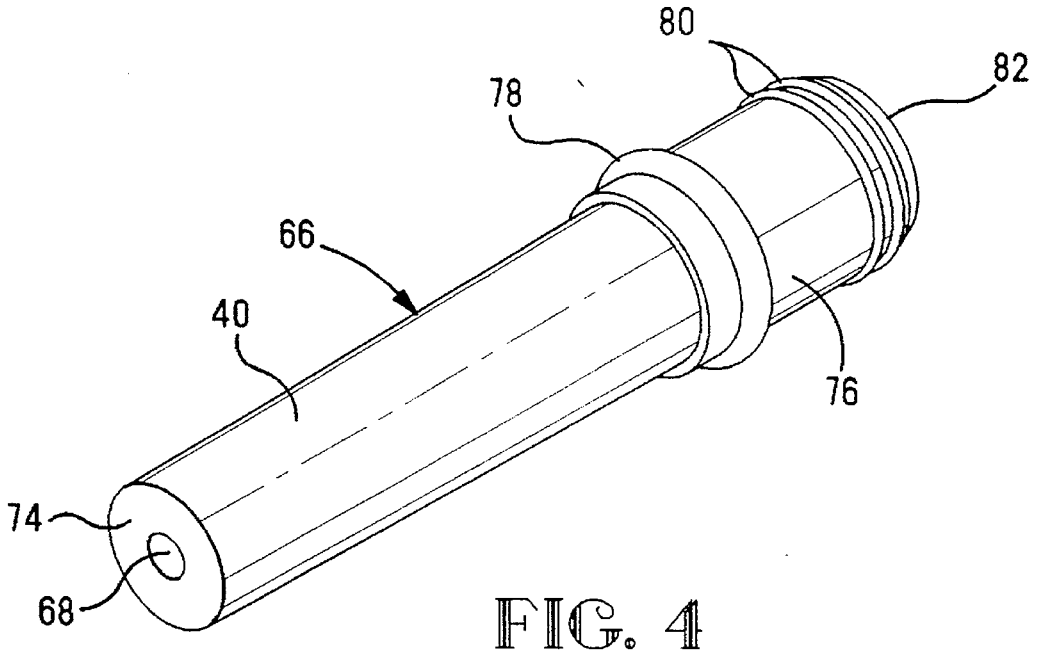
FIG. 4 is an isometric view of an elastomeric seal of FIG. 3.
Figure 3:
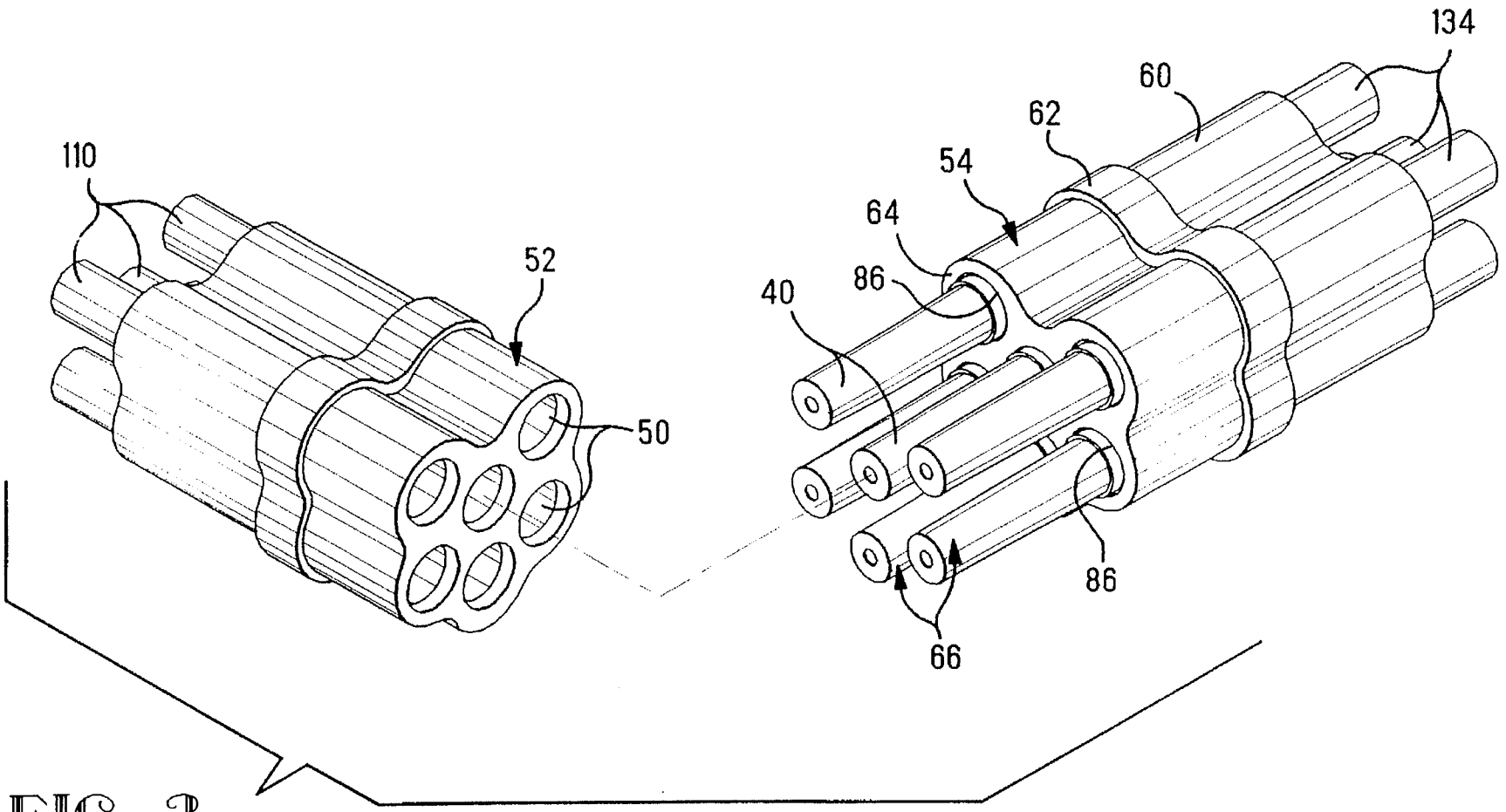
FIG. 3 is an isometric view of the mating faces of the inserts of the connectors of FIG. 1, with one thereof containing elastomeric seals of the present invention.

Referring to FIG. 3, silo-receiving recesses 50 are defined by an insert 52 that is disposed within central region 48 of plug connector 14. Silos 40 are portions of an insert 54 that is disposed within central region 46 (FIG. 2). Within each silo-receiving recess 50 is contained a pin contact section 56 of a pin terminal 58 (seen in FIGS. 6 to 8). Altogether, inserts 52 and 54 comprise a high voltage low current electrical connector that provides protection against undesirable voltage leakage and the generation of corona during transmission of high voltage low current signals. Insert 52 may also comprise a pair of three-position high voltage inserts nested together within central region 46; such arrangement allows the high voltage cables to be assembled in three-conductor cable harnesses each with a respective insert, facilitating repair and replacement.

Figure 5:
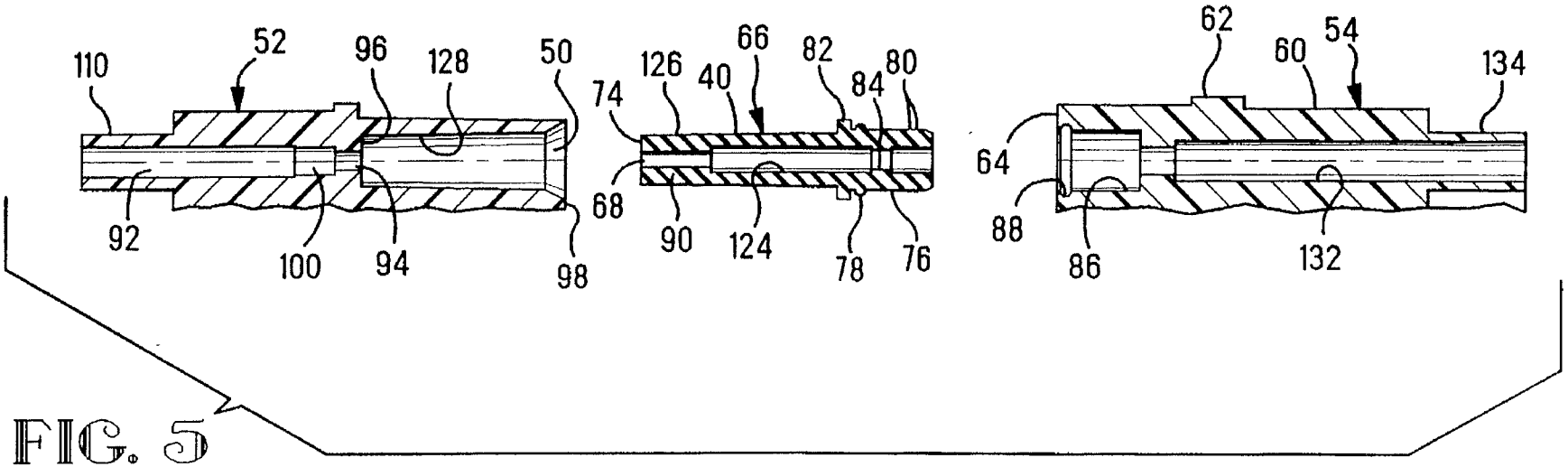
FIGS. 5 and 6 are longitudinal section views of a high voltage terminal site, with FIG. 5 having the inserts and elastomeric member exploded and without terminals, and FIG. 6 being assembled with terminals and mated.

In FIGS. 3 and 5, insert 54 comprises a molded dielectric body 60 having a flange section 62 encircling it spaced from the leading end 64 of body 60 that becomes positioned between the forward and rearward housing sections in which is disposed a retention clip of appropriate configuration seated within a groove defined between the forward and rearward housing sections, with the retention clip containing arrays of locking lances engaging the flange section 62. Preferably the rearward housing section includes axial channels coextending along the insert from rearwardly thereof permitting insertion of a tool to disengage the locking lances of the retention clip from flange section 62 for removal of insert 54 during servicing and repair. Insert 52 similarly has such an encircling flange cooperable with plug connector housing assembly 32 and a retention clip thereof.

Silos 40 are portions of members 66 molded of elastomeric material such as silicone rubber, a material commonly used in high voltage connectors. Each member 66 is associated with a particular socket terminal 44 that is disposed along a passageway 68 thereof, with a socket contact section 42 thereof disposed along and within silo 40 such that leading end 72 is recessed from silo leading end 74 (FIGS. 6 to 9). Member 66 also includes a body portion 76, an annular embossment 78 spaced rearwardly of the base of the silo portion along body portion 76 and further includes a pair of small dimensioned embossments 80 proximate the rearward end thereof.

Referring now to FIG. 5, longitudinal section views of inserts 52 and 54 and of elastomeric member 66 reveal passageways thereof through which the socket and pin terminals will be disposed. In elastomeric member 66, a reduced diameter portion is defined along passageway 68 at internal annular embossment 84 to grip the socket terminal upon assembly. An annular flange 82 is shown placed at the base of the silo portion to extend along and against the adjacent portions of forward surface 64 of insert 54. Such a flange 82 effectively closes off the entrance to aperture 86 of insert 54 into which body portion 76 is inserted during assembly. Where a lead-in to silo-receiving recess 50 is not utilized to facilitate blind mating of the silos in the respective recesses, such a flange is especially useful to seal between facing surfaces 64 and 98 of inserts 52,54 upon full mating peripherally about each mated terminal pair at the base of the silos, providing enhanced sealing performance; overcompression of such a flange between surfaces 64, 98 should be avoided to prevent damage to the elastomeric member and subsequent reduction in sealing effectiveness.

In aperture 86 of insert 54, an annular groove 88 is seen proximate forward surface 64 of insert body 60 and is associated with annular embossment 78 of elastomeric member 66 acting as a seat therefor during assembly. Silo 40 is shown to include at its leading end 74 a reduced diameter passageway portion 90 to be disposed initially spaced forwardly of the leading end of the socket contact section prior to full connector mating, with an inner diameter selected to be just large enough for receipt of a mating pin contact section thereinto to become electrically engaged with the socket contact section. Silo-receiving recess 50 is shown to be an enlarged diameter forward portion of passageway 92, with a reduced diameter portion 94 thereof creating a forwardly facing surface 96 defining the bottom of the silo-receiving recess. The depth of silo-receiving recess 50 is selected to be less than the length of silo 40 to be eventually received thereinto and longitudinally compressed thereby when connectors 12,14 become fully mated and portions of forward surface 98 of insert 52 are adjacent forward surface 64 of insert 54 at the base of silo 40. An enlarged passageway portion 100 rearwardly of reduced diameter portion 94 will receive therealong a body portion of a pin terminal.

In FIG. 6 a pin terminal 58 has been disposed in and along the passageway of insert 52 with body portion 102 disposed in enlarged passageway portion 100 and a rearward termination section 104 terminated to a conductor of a respective high voltage cable 106 such as by crimping. Preferably the pin terminal and adjacent portions of the conductor are coated with a silicone rubber adhesive prior to insertion, to establish a bond for securing in the passageway; silicone rubber RTV adhesive No. 744 by Dow Corning may be used, and the terminal should be held carefully centered within the slightly larger passageway until adhesive curing occurs. Also, a length of heat recoverable tubing 108 is preferably utilized to surround and seal the tubular flange 110 extending rearwardly from insert 52 as well as adjacent portions of the high voltage cable 106. Elastomeric member 66 has been assembled within aperture 86 of insert 54 by interference fit, with annular embossment 78 seated within annular groove 88. A socket terminal 44 has been disposed in passageway 68 of elastomeric member 66 and through aperture 86 of insert 54, with body portion 112 gripped tightly at annular embossment 84 which is radially expanded upon terminal insertion. A rearward termination section 114 of socket terminal 44 is terminated to a conductor of a respective high voltage cable 116, such as by crimping. Preferably socket terminal 44 includes an annular collar 118 adapted to abut a rearwardly facing surface 120 along a rearward aperture portion 122 of insert 54 to serve as a positive stop during insertion of socket terminal 44 aperture portion 132 after being crimped to the cable conductor. A length of heat recoverable tubing 108 is preferably used to seal the tubular flange 134 extending from insert 54 and adjacent portions of high voltage cable 116. Each of the lengths of heat recoverable tubing may utilize sealant preforms for bonding to the annular flange and cable insulation upon heating of the lengths of heat recoverable tubing to reduce the tubing diameter to conform to the encased surfaces.

Figure 9:
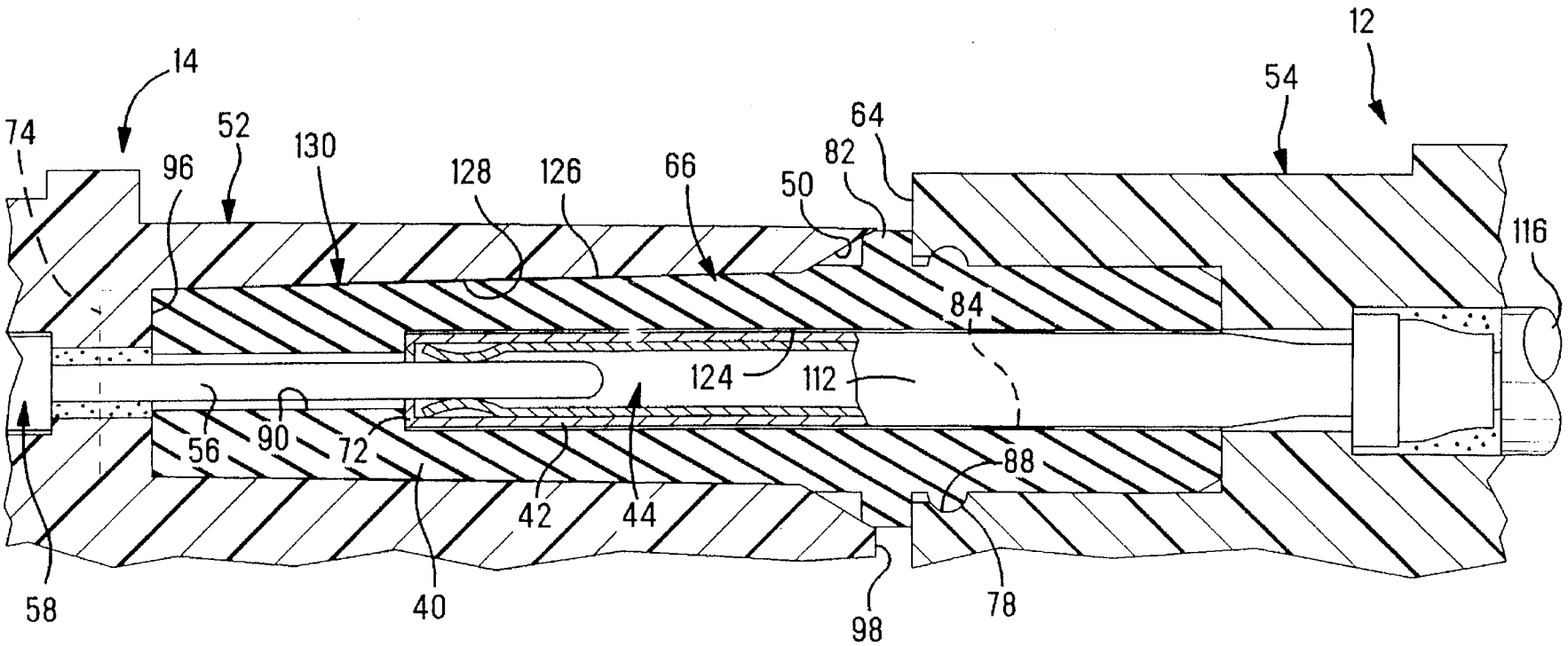

The present invention will now be more fully described with respect to FIGS. 7 to 9. In FIG. 7, connectors 12 and 14 are partially mated, and it can be seen that leading end 72 of socket contact section 70 is spaced rearwardly a distance from reduced diameter passageway portion 90 adjacent silo leading end 74, with a substantial portion of pin contact section 56 having entered socket contact section 70 to be electrically engaged with spring arms 120 within hood 122. Silo leading end 74 is shown in abutment with bottom 96 of silo-receiving recess 50 of insert 52. Forward surface 98 of insert 52 is shown spaced from forward surface 64 of insert 54. Silo leading end 74 is seen to have an outer diameter no greater than the inner diameter of silo-receiving recess 50 adjacent recess bottom 96. The angle of taper of the silo is seen to be just less than the angle of taper of the silo-receiving recess so that a slight annular gap exists at this point between silo 40 and silo-receiving recess 50 spaced from silo leading end 74.

Referring to FIG. 8, connectors 12 and 14 are almost fully mated. Forward surfaces 98 and 64 of the inserts are now close together. Silo 40 is now undergoing longitudinal compression as a result of connectors 12 and 14 continuing to be urged toward each other after silo leading end 74 has abutted recess bottom 96. The inner surface 124 of silo 40 is not bonded to the outer surface of socket contact section 42, so that as silo 40 undergoes longitudinal compression it is not hindered by a bond or by significant frictional force with the socket contact section. Consequently, socket contact leading end 72 is seen to move relatively forwardly along passageway 68 toward reduced diameter portion 90 thereof at silo leading end 74. It is also seen that silo 40 begins to be deformed or expanded radially outwardly for outer surface 126 thereof to be engaged with and compressed against inner surface 128 of silo-receiving recess 50, beginning at silo leading end 74 and progressing rearwardly along the silo because of the shape of the frustoconical gap between frustoconical surfaces 126 and 128.

In FIG. 9, connectors 12, 14 are fully mated. Forward surfaces 98,64 of the inserts have been moved adjacent each other. For purposes of comparison, the original length of silo 40 is shown in phantom extending to silo leading end 74. Preferably no gap remains between socket contact leading end 72 and reduced diameter passageway portion 90. Outer surface 126 is seen to have become pressed against inner surface 128 of silo-receiving recess 50 along the length of silo 40, thus establishing an assured compression seal 130 of the elastomeric material of the silo and the rigid material of insert 52. Additionally, the elastomeric material of silo 40 next to flange 82 has been radially expanded at the tapered lead-in entrance to silo-receiving recess 50. Further, radial expansion occurs at the entrance to aperture 86 forwardly of annular embossment 78, at annular embossment itself to press it more firmly into annular groove 88, and at base portion 76, all as elastomeric member 66 is longitudinally compressed against the bottom of aperture 86. Compression seal 130 provides an effective seal of substantial axial length about and adjacent its respective mated pair of electrical contacts minimizing the development of a possible voltage leakage path thereat. With each such mated pair of contacts of the high voltage portion of the connectors having assured seals adjacent thereto, the mating interface of the high voltage portion of the mated connectors is effectively sealed against voltage leakage and corona.

As the compression of outer silo surface 126 against inner recess surface 128 progresses from silo leading end 74 rearwardly along the outer silo surface, air is effectively expressed away from the mating contact sections and outwardly of the mating interface prior to full mating as in FIGS. 6 and 9.

The inner diameter of passageway 68 of the silo portion of elastomeric member 66 is preferably incrementally greater than the outer diameter of socket contact section 42 to permit movement of the silo inner surface therealong with only modest friction as silo 40 undergoes compression. The outer diameter of silo 40 is preferably incrementally less than the inner diameter of the silo-receiving recess 50 at corresponding axial locations, except at silo leading end 74 and recess bottom 96 where the diameter of silo leading end 74 is no larger than the diameter at recess bottom 96. The angle of taper of the silo is preferably just less than the angle of taper of the sidewalls of the silo-receiving recess 50. It is believed that air trapped within the silo and adjacent (or forwardly of) the pin and socket contacts pressurizes the elastomeric material of the silo to assist in radial expansion to press the material more tightly against the inner surfaces of the silo-receiving recess.

Preferably the elastomeric material used for elastomeric member 66 is a silicone rubber, such as SILASTIC 55U high tensile strength silicone rubber sold by The Dow Corning Company of Plymouth, Mich. Dielectric material for inserts 52 and 54 may be polyetherether ketone (PEEK) such as POLYPENCO 450G sold by Polypenco, Ltd. of Hertfordshire, England. The angle of taper of the silo may be about 0.72°, and the angle of taper of the complementary silo-receiving recess may be about 1.31°. The space between socket contact leading end and the reduced diameter passageway portion at the silo leading end is initially about 0.050 inches at assembly, prior to connector mating. Also, where no flange 82 is used, preferably the height of the silo is about 0.10 inches longer than the depth of the silo-receiving recess, and the leading end portion 90 of the elastomeric member's silo portion is compressed about 0.050 inches. For versions where flange 82 is used but no lead-in is formed at the entrance to silo-receiving recess 50, care should be taken to engage but not overcompress such flange 82, and less longitudinal compression of silo 40 is believed necessary to obtain effective sealing since the flange abuts and seals against forward surfaces of both inserts completely about the entrance to the silo-receiving recess, and the height of the silo therefore need be only about 0.050 inches longer than the depth of the silo-receiving recess. Providing an elastomeric member having a base portion length slightly longer from the rearward end to the annular embossment than the length of the aperture between the aperture bottom surface and the annular groove, allows compression of the member's base portion at assembly thereby radially expanded the base portion against the aperture sidewalls before connector mating and serves to enhance the sealing thereat.

It may be desirable to provide elastomeric members that have no annular flange about their base portions; this would enable closer spacing of adjacent terminal sites for higher density. A variation of the present invention could utilize elastomeric portions molded about individual terminal sites, or an integral elastomeric forward housing portion defining all terminal sites instead of discrete members therefor. It can be seen that a high voltage connector utilizing the present invention can have an effectively sealed mating interface with only one mating pair of electrical terminals, as well as with a plurality thereof. Also a hybrid electrical connector may have a high voltage low current transmission portion in addition to conventional low voltage signal transmission portion, by utilizing an insert having the present invention therein. Other variations and modifications may be made that are within the spirit of the invention and the scope of the claims.

What is claimed is:

1. An electrical connector assembly suitable for high voltage low current transmission, comprising:

a first connector including a housing including elastomeric portions surrounding each terminal site of said first connector, and respective socket terminals terminated to respective conductor wires disposed within respective passageways through respective said elastomeric portions and extending from a first mating face of said first connector to a wire exit face thereof, with socket contact sections of said socket terminals disposed within respective forwardly-extending silos of said elastomeric portions to socket contact leading ends exposed along said first mating face for electrical engagement, with said socket contact sections adapted to permit relative movement with respect to adjacent surfaces of said passageways through said elastomeric portions;

a second connector including a housing of substantially rigid dielectric material and including passageways extending therethrough from a wire exit face to a mating face thereof, said housing including pin terminals terminated to respective conductor wires and disposed through respective said passageways, said pin terminals including pin contact sections complementary with and matable with respective said socket contact sections upon connector mating, and said housing including silo-receiving recesses extending rearwardly from said mating face complementary with respective said silos;

each said silo defining an outer surface and each said silo-receiving recess defining an inner surface dimensioned for sealing engagement therewith upon full connector mating, and said inner surface of each said silo-receiving recess has a gradual taper and said outer surface of each said silo has a complementary taper; and each said silo extending a first selected distance, and each said silo-receiving recess having a recess bottom abuttable by said silo leading end and spaced a second selected distance from said second mating face, all such that said silo leading end abuts said recess bottom prior to full connector mating and is longitudinally compressed upon complete connector mating and is radially expanded for said outer surface of said silo to be compressed tightly against said inner surface of said silo-receiving recess upon full connector mating, whereby assured seals are established surrounding and adjacent said sites of said pin and socket terminals when electrically engaged minimizing formation of voltage leakage paths and inhibiting corona formation during high voltage low current transmission.

2. A high voltage connector assembly as set forth in claim 1 wherein said adjacent surfaces of said passageways of said first connector are spaced from outer surfaces of said socket contact sections therewithin.

3. A high voltage connector assembly as set forth in claim 1 wherein an entrance to a said silo-receiving recess is tapered to define a lead-in facilitating receipt of said silo leading end thereinto during connector mating.

4. A high voltage connector assembly as set forth in claim 1 wherein each said elastomeric portion is disposed forwardly of a rigid portion of said housing of said first connector providing a support assisting in longitudinal compression of said silo upon full connector mating.

5. A high voltage connector assembly as set forth in claim 1 wherein said passageway of said elastomeric portion includes an annular constriction dimensioned to grippingly engage an outer surface of a body portion of a said socket terminal inserted into and along said passageway for sealing thereagainst, said annular constriction being disposed substantially rearwardly from said socket contact leading end.

6. A high voltage connector assembly as set forth in claim 1 wherein said recess bottom is defined by said housing of substantially rigid dielectric material.

7. A high voltage connector assembly as set forth in claim 1 wherein a leading end portion of a respective said elastomeric portion adjacent said silo leading end extends forwardly beyond said socket contact leading end a third selected distance.

8. A high voltage connector assembly as set forth in claim 7 wherein a passageway portion through said leading end portion is less in diameter than an outer diameter of said socket contact leading end, and said silo leading end portion is spaced a selected distance forwardly of said socket contact leading end.

9. A high voltage connector assembly as set forth in claim 1 wherein said housing of said first connector includes a housing section of rigid dielectric material having a transverse body section including apertures extending therethrough, and said elastomeric portions are discrete members having body portions adjoining said silos, said body portions being inserted into and secured in respective said apertures in sealing engagement with said apertures and in a manner preventing axial movement with respect thereto during connector mating and unmating.

10. A high voltage connector assembly as set forth in claim 9 wherein said elastomeric member includes an annular flange surrounding a base portion of said silo and extending laterally along a forward surface of said housing section of said first connector, said annular flange being larger in diameter than an entrance to a respective said aperture of said housing section of said first connector, and said housing section of said first connector and said housing of said second connector are adapted to be moved together at full mating thereof such that an adjacent portion of a forward surface of said housing of said second connector at least abuts said annular flange without overcompression thereof.

11. A high voltage connector assembly as set forth in claim 10 wherein an entrance to a said silo-receiving recess is tapered to define a lead-in facilitating receipt of said silo leading end thereinto during connector mating, and said annular flange of an associated said elastomeric member is dimensioned to be partially received into said entrance and partially compressed therewithin.

12. A high voltage connector assembly as set forth in claim 9 wherein said adjacent surfaces of said elastomeric members along said passageways are incrementally spaced from outer surfaces of said socket contact sections therewithin.

13. A high voltage connector assembly as set forth in claim 12 wherein said passageway of said elastomeric member includes an annular constriction dimensioned to grippingly engage an outer surface of a body portion of a said socket terminal inserted into and along said passageway for sealing thereagainst.

14. A high voltage connector assembly as set forth in claim 9 wherein said elastomeric member includes an annular embossment therearound proximate a base of said silo positioned axially to be disposed within a respective said aperture of said housing of said first connector and seated within an annular groove of said aperture in interference fit to stabilize the axial location of said elastomeric member with respect to said aperture and enhance a sealing engagement between said elastomeric member and said housing section of rigid material.

15. A high voltage connector assembly as set forth in claim 14 wherein said elastomeric member includes at least one annular embossment proximate a rearward end portion thereof dimensioned slightly greater than said aperture of said housing section of said first connector to become compressed upon insertion of said body portion into said aperture for enhanced sealing therealong.

16. A high voltage connector assembly as set forth in claim 14 wherein said elastomeric member has a base portion length slightly longer from a member rearward end to said annular embossment than an axial length of said aperture between a bottom surface thereof and said annular groove, allowing longitudinal compression of said base portion at assembly thereby radially expanding said base portion against aperture sidewalls before connector mating and serving to enhance sealing thereat.

17. An electrical connector assembly suitable for high voltage low current transmission, of the type wherein a first connector includes a housing including at least one socket terminal disposed therethrough extending to a socket contact section exposed along a first mating face for electrical engagement, and further including a forward section of elastomeric material along each said socket contact section and therebeyond, and a second connector includes a housing of rigid dielectric material having a second mating face, said rigid housing including at least one pin terminal disposed therethrough extending to a pin contact section exposed along said second mating face for electrical engagement with said socket contact section, characterized in that:

said elastomeric forward section provides a portion of elastomeric material extending to a leading end, said elastomeric portion being disposed along and only incrementally spaced from a base portion of each said at least one pin contact section upon connector mating, and said rigid housing providing a portion-receiving recess at least along each said pin contact base portion and adapted to receive thereinto said portion of elastomeric material during connector mating and further providing a noncompressible recess bottom associated with said portion leading end; and said connectors are adapted such that in final stages of connector mating said recess bottom engages said portion leading end just prior to full mating, and thereafter axially compresses said portion such that said portion is deformed outwardly against side walls of said portion-receiving recess to define a discrete terminal site seal adjacent and along at least said pin contact base section of each mated terminal pair.

18. An electrical connector assembly as set forth in claim 17 wherein said portion of elastomeric material is adapted to move relative to said socket contact leading end.

* * * * *